US010899418B1

(12) United States Patent
Muzzio

(10) Patent No.: US 10,899,418 B1
(45) Date of Patent: Jan. 26, 2021

(54) UNIVERSAL CHANNEL ROD ADJUSTABLE EXTENSION APPARATUS

(71) Applicant: Matthew D. Muzzio, Land O' Lakes, FL (US)

(72) Inventor: Matthew D. Muzzio, Land O' Lakes, FL (US)

( * ) Notice: Subject to any disclaimer, the term of this patent is extended or adjusted under 35 U.S.C. 154(b) by 0 days.

(21) Appl. No.: 16/948,711

(22) Filed: Sep. 29, 2020

Related U.S. Application Data

(60) Provisional application No. 62/937,071, filed on Nov. 18, 2019.

(51) Int. Cl.
*B63B 17/02* (2006.01)
*B63B 83/00* (2020.01)

(52) U.S. Cl.
CPC ..... *B63B 17/02* (2013.01); *B63B 83/00* (2020.01)

(58) Field of Classification Search
CPC ..... B63B 17/02; B63B 83/00; E04H 15/32; E04H 15/64; E04F 10/00; E04F 10/10
See application file for complete search history.

(56) References Cited

U.S. PATENT DOCUMENTS 5,564,217 A * 10/1996 Riedell ..... A01K 97/10 43/21.2
5,683,199 A * 11/1997 Tehan ..... A43C 9/06 135/127
10,407,133 B1 9/2019 Muzzio

* cited by examiner

*Primary Examiner* — Anthony D Wiest
(74) *Attorney, Agent, or Firm* — Smith & Hopen, P.A.; Paul Murty

(57) ABSTRACT

A channel rod extension that provides access to the flexible cord through an opening of the extension, thereby allowing a user to quickly customize a length of the flexible cord and, accordingly, to quickly customize a dimension of the flexible cord-based system. The channel rod extension system includes an elongated extension with a discontinuous outer wall, forming a channel within which a flexible cord is received. A retainer made of a material having a high coefficient of friction surmounts the elongated extension to secure the flexible cord in place. To extend a dimension of the flexible cord-based system, the flexible cord is stretched and retained in place via the retainer, thereby elongating a dimension of the flexible cord-based system.

19 Claims, 5 Drawing Sheets

UNIVERSAL CHANNEL ROD ADJUSTABLE EXTENSION APPARATUS

CROSS-REFERENCE TO RELATED APPLICATIONS

This nonprovisional application is a continuation of and claims priority to U.S. provisional patent application No. 62/937,071, entitled "Universal Lightweight Corded Pole Extension," filed on Nov. 18, 2019 by the same inventor, the entirety of which is incorporated herein by reference.

BACKGROUND OF THE INVENTION

1. Field of the Invention

This invention relates, generally, to dimension adjustment apparatuses. More specifically, it relates to a universal channel rod extension designed for use in combination with a flexible cord-based system, such that the channel rod extension can be used to extend or customize a linear dimension of the flexible cord-based system.

2. Brief Description of the Prior Art

Devices such as overhangs, canopies, and other overhead coverings are often required when spending time outdoors. Whether a person spends time in a backyard, on a watercraft, or in an open-top vehicle, it is desirable to provide some sort of shade during outdoor activities. Moreover, weather conditions can be harmful to persons spending too much time outside, potentially exposing those outside to dangerous temperatures and damaging ultraviolet rays. For example, exposure to UV rays can lead to the development of squamous cell skin carcinoma and melanoma.

While shade-providing devices exist to decrease exposure to harmful UV rays, such device typically function in single-size configurations. For example, many awnings do not include real-time, customizable dimension options; most devices are simply deployed or stored, with little choice therebetween for shading options. Moreover, the devices that include customizable dimensions often require a complex mechanical component which requires mechanical force to change between orientations, such as increment-based ratchet mechanisms to preselected, finite dimensions. While such devices provide a user with some options regarding shading configurations and angles, the lack of true universality and the mechanical requirements make such devices inadequate for many shading uses.

Accordingly, what is needed is a universal channel rod extension designed for use in combination with a flexible cord-based system. The universal channel rod extension can be utilized in a number of implementations, including retrofitting into existing structures, to provide real-time and infinitely customizable dimension optimization for a structure. However, in view of the art considered as a whole at the time the present invention was made, it was not obvious to those of ordinary skill in the field of this invention how the shortcomings of the prior art could be overcome.

All referenced publications are incorporated herein by reference in their entirety. Furthermore, where a definition or use of a term in a reference, which is incorporated by reference herein, is inconsistent or contrary to the definition of that term provided herein, the definition of that term provided herein applies and the definition of that term in the reference does not apply.

While certain aspects of conventional technologies have been discussed to facilitate disclosure of the invention, Applicant in no way disclaims these technical aspects, and it is contemplated that the claimed invention may encompass one or more of the conventional technical aspects discussed herein.

The present invention may address one or more of the problems and deficiencies of the prior art discussed above. However, it is contemplated that the invention may prove useful in addressing other problems and deficiencies in a number of technical areas. Therefore, the claimed invention should not necessarily be construed as limited to addressing any of the particular problems or deficiencies discussed herein.

In this specification, where a document, act or item of knowledge is referred to or discussed, this reference or discussion is not an admission that the document, act or item of knowledge or any combination thereof was at the priority date, publicly available, known to the public, part of common general knowledge, or otherwise constitutes prior art under the applicable statutory provisions; or is known to be relevant to an attempt to solve any problem with which this specification is concerned.

BRIEF SUMMARY OF THE INVENTION

The long-standing but heretofore unfulfilled need for a universal channel rod extension designed for use in combination with a flexible cord-based system is now met by a new, useful, and nonobvious invention.

The novel structure includes a channel rod extension having an elongated main body extending between a first end and a second end along a longitudinal axis. The main body includes a discontinuous outer surface defining a channel to an interior wall of the main body. An elongated flexible cord is removably secured to the main body. The flexible cord is receivable within the channel and extends from at least the first end to the second end of the main body. The flexible cord includes a diameter that is smaller than a diameter of the channel. In an embodiment, the flexible cord is an elastic shock cord.

A retainer is slidably secured to the main body and is disposed between the first end and the second end. The retainer includes a continuous inner-facing wall defining an opening therebetween, with the opening spanning an inner diameter greater than an outer diameter of the main body, such that the retainer is configured to retain the flexible cord within the channel. The retainer is made of a material having a coefficient of friction greater than a coefficient of friction of the main body. For example, in an embodiment, in a default configuration, the flexible cord includes a first length, and in an elongated configuration, the flexible cord includes a second length greater than the first length. Due to the coefficient of friction of the retainer, the retainer maintains the flexible cord at the second length, thereby adjusting a dimension, such as a height or a length, of a frame structure to which the extension connects.

In an embodiment, a first end cap is secured to the first end of the main body, with the first end cap being configured to surmount the first end of the main body to retain the flexible cord within the channel. The first end cap includes an inner diameter greater than the outer diameter of the main body, such that the first end cap surmounts and forms a press fit with the main body. The first end cap may include an outer terminal diameter greater than the outer diameter of the main body, such that the first end cap is configured to form an attachment point receivable within an anchor point of a watercraft vessel.

In an embodiment, a second end cap is secured to the second end of the main body, with the second end cap being configured to surmount the second end of the main body to retain the flexible cord within the channel. The second end cap includes an inner diameter greater than the outer diameter of the main body, such that the second end cap surmounts and forms a press fit with the main body. The second end cap may be a ferrule configured to indirectly secure the channel rod to a frame structure. In an embodiment, the retainer is configured to slidably translate along a longitudinal axis of the channel rod extension, such that the retainer is configured to adjust a length of the flexible cord by translating the second end cap in a longitudinal direction away from the first end cap.

The novel method includes a step of securing a flexible cord within a channel of a channel rod extension, the channel being defined by a discontinuous outer surface of the channel rod extension. A first end of the channel rod extension is coupled to an anchor point. A second end of the channel rod extension is coupled to an intermediary connector on a frame structure, the intermediary connector being spaced apart from the anchor point thereby defining an initial position of the intermediary connector. The method includes a step of retaining the flexible cord within the channel via a retainer disposed between the first end and the second end. The retainer is slidably translated along a longitudinal axis of the channel rod extension in a direction toward the second end, with the longitudinal axis spanning between the first end and the second end. The retainer translates the intermediary connector along the longitudinal axis away from the anchor point, thereby exerting a force on the flexible cord to elongate the flexible cord, such that the intermediary connector is spaced apart from the anchor point to define an extended position, with the extended position being greater than the initial position.

In an embodiment, the channel rod extension is a first channel rod extension, and the method includes a step of replacing the first channel rod extension with a second channel rod extension. The second channel rod extension has a length greater than an associated length of the first channel rod extension, such that the second channel rod extension adjusts the position of the frame structure. In an embodiment, the method includes steps of disposing a second channel rod extension adjacent to the first channel rod extension; aligning a channel of the second channel rod extension with the channel of the first channel rod extension; and securing the flexible cord within the channel of each of the first channel rod extension and the second channel rod extension, thereby adjusting a dimension of the frame structure, such as a height or a length.

An option of the invention is to provide a user with a way to customize a dimension of a structure in real time without being tied to a finite amount of increments, such that the user can implement a structure in an optimal configuration depending on an activity and the user's positioning.

These and other important objects, advantages, and features of the invention will become clear as this disclosure proceeds.

The invention accordingly comprises the features of construction, combination of elements, and arrangement of parts that will be exemplified in the disclosure set forth hereinafter and the scope of the invention will be indicated in the claims.

BRIEF DESCRIPTION OF THE DRAWINGS

For a fuller understanding of the invention, reference should be made to the following detailed description, taken in connection with the accompanying drawings, in which.

DETAILED DESCRIPTION OF THE INVENTION

In the following detailed description of the preferred embodiments, reference is made to the accompanying drawings, which form a part thereof, and within which are shown by way of illustration specific embodiments by which the invention may be practiced. It is to be understood that other embodiments may be utilized, and structural changes may be made without departing from the scope of the invention.

As used in this specification and the appended claims, the singular forms "a," "an," and "the" include plural referents unless the content clearly dictates otherwise. As used in this specification and the appended claims, the term "or" is generally employed in its sense including "and/or" unless the context clearly dictates otherwise.

The present invention includes a universal channel rod extension designed for use in combination with a flexible cord-based system. Typically, a flexible cord-based system includes a flexible cord, such as a shock cord, other elastic cord, standard cord, or wire that is disposed through one or more substantially hollow, tubular support members. As used herein, "flexible" means an object having a dimension, such as a height or a length, that is extendable upon receiving a force from a user or from an object, and that rebounds to a position of repose in the absence of a received force. The shock cord is an elastic string that experiences a tension when its length is greater than its natural length, thereby maintaining a connection between support members. As such, in a flexible cord-based system, the system maintains its structure as an assembly of shock cords are disposed through tubes and stretched into a final position, typically secured within an anchor point.

However, such systems rely on the anchor points themselves, as well as the length of the shock cords to determine a dimension of the system, such as a height or a length. Since the tubes used within the systems are hollow, the shock cord is restricted from movement based on the perimeter of the tubes, and dimension customization is thereby limited to the locations of the physical anchor points within the system. Instead, the present invention includes a channel rod extension that provides access to the elastic cord through an opening of the extension, thereby allowing a user to quickly customize a length of the elastic cord and, accordingly, to quickly customize a dimension of the flexible cord-based system.

Figure 1:
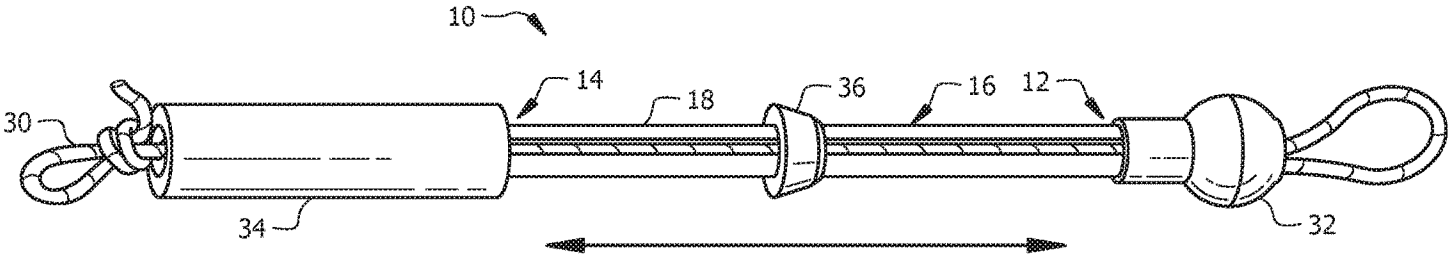
FIG. 1 is an orthogonal view of an assembled channel rod extension system, in accordance with an embodiment of the present invention.
Figure 2:
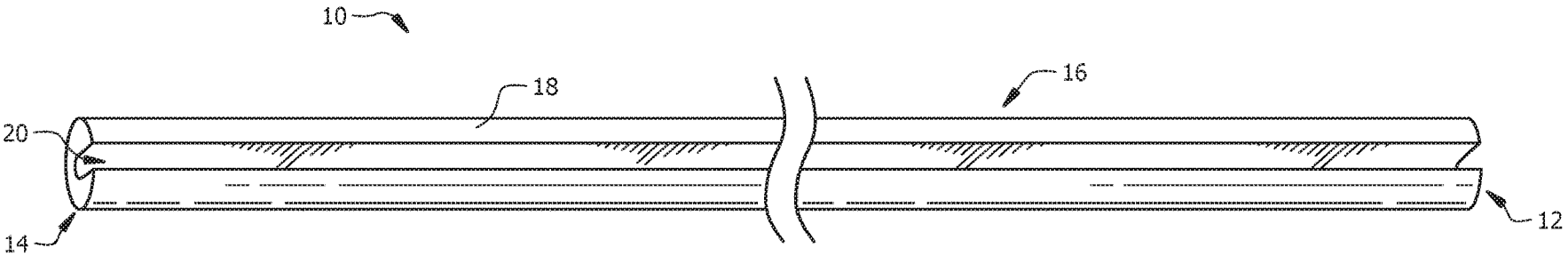
FIG. 2 is a close-up orthogonal view of the channel rod extension of FIG. 1.
Figure 3:
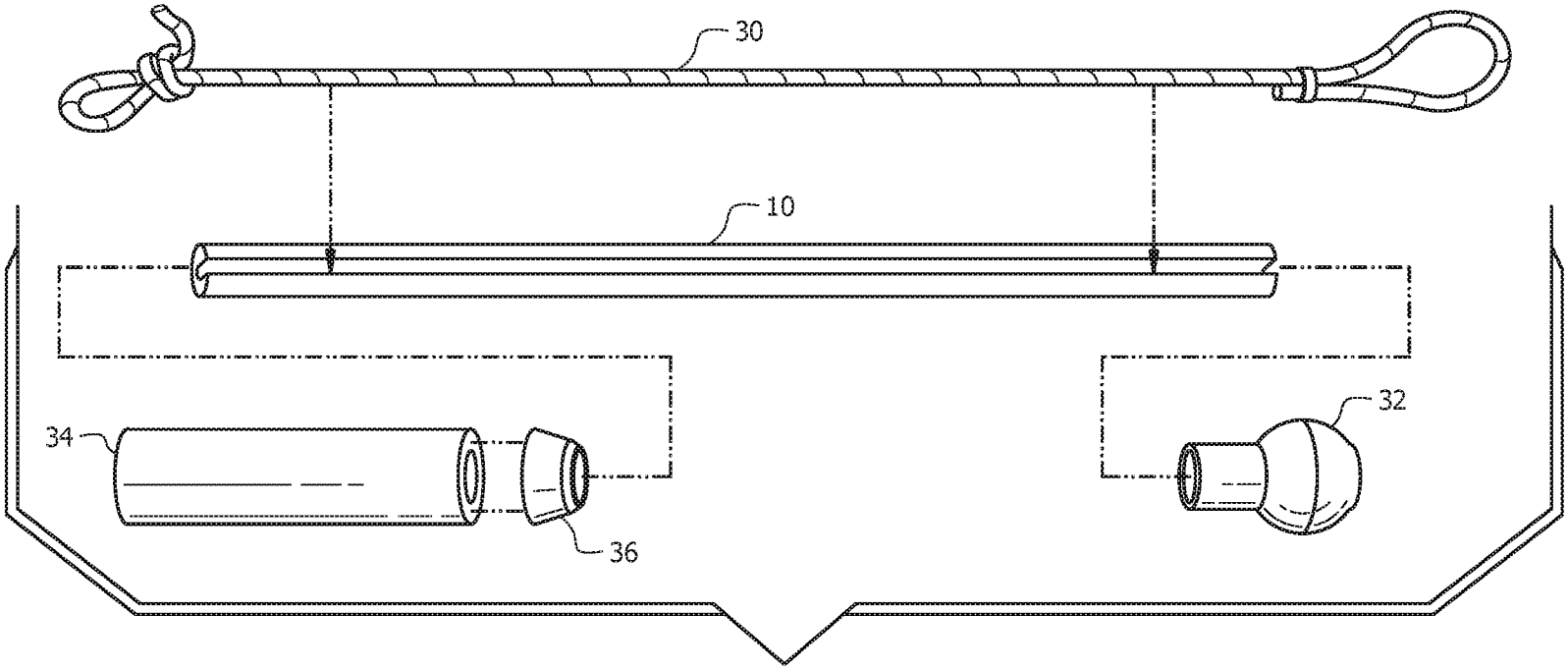
FIG. 3 is an exploded orthogonal view of the channel rod extension system of FIG. 1.

Accordingly, as shown in FIGS. 1-3, an embodiment of the present invention includes universal channel rod extension 10 (alternatively referred to as extension 10 or channel rod extension 10 herein). Extension 10 includes first end 12 opposite second end 14, with body 16 extending therebetween along a longitudinal axis of extension 10. Importantly, extension 10 includes outer surface 18 that is discontinuous in at least one dimension. For example, in the embodiment shown in FIGS. 1-3, extension 10 is cylindrical in shape, with outer surface 18 forming an outer perimeter of extension 10. Because outer surface 18 is discontinuous in at least one dimension, in the embodiment of FIGS. 1-3, outer surface 18 includes a gap between adjacent walls thereof, defining channel 20 to an interior surface of extension 10. Channel 20 is formed within outer surface 18 and extends throughout the longitudinal axis of extension 10, such that channel 20 is defined from first end 12 through second end 14. As such, extension 10 is designed to receive an object therein, as will be described in greater detail below.

FIGS. 1-3 also depict an embodiment of extension 10 including flexible cord 30 (such as a shock cord) received within channel 20 of extension 10. To receive flexible cord 30 therein, channel 20 defines a volume that is effectively greater than a volume of flexible cord 30. Moreover, channel 20 includes an associated width (defined along a lateral axis of extension 10, which intersects with the longitudinal axis of extension 10) that is greater than an associated width of flexible cord 30. The width of flexible cord 30 is defined along a lateral axis of flexible cord 30; for example, in the embodiment of FIGS. 1-3, the lateral axis of each of flexible cord 30 and extension 10 is parallel to a diameter of each of flexible cord 30 and extension 10, respectively. Accordingly, extension 10 is sized and shaped such that flexible cord 30 is receivable within extension 10.

Moreover, FIGS. 1-3 depict an embodiment of a retention mechanism designed to secure flexible cord 30 within extension 10. Since extension 10 includes a discontinuous outer surface 18, such a retention mechanism is required to ensure that flexible cord 30 does not easily detach from extension 10 during use. Moreover, a removable retention mechanism allows a user to easily access and manipulate flexible cord 30 without requiring that the user entirely disassemble extension 10 from the overall flexible cord system, thereby allowing a user to accomplish real-time adjustments of the system.

In an embodiment shown in FIGS. 1-3, the retention mechanism includes first end cap 32 opposite second end cap 34. Each of the end caps secures to a respective end of extension 10, such that first end cap 32 is disposed adjacent to first end 12 of extension 10, and such that second end cap 34 is disposed adjacent to second end 14 of extension 10. As such, opposing ends of flexible cord 30 are secured to each of first end cap 32 and second end cap 34, such that flexible cord 30 is retained within extension 10 without the ability to detach from extension 10 without receiving a secondary force. To secure to extension 10 and deter the relative movement of flexible cord 30 with respect to extension 10, each of first end cap 32 and second end cap 34 includes an associated inner diameter slightly greater than an outer diameter of extension 10 at each of first end 12 and second end 14, respectively. As such, each end cap forms a press fit with a respective end of extension 10, thereby securing each end cap to a respective end in a detachable relationship.

Figure 4:
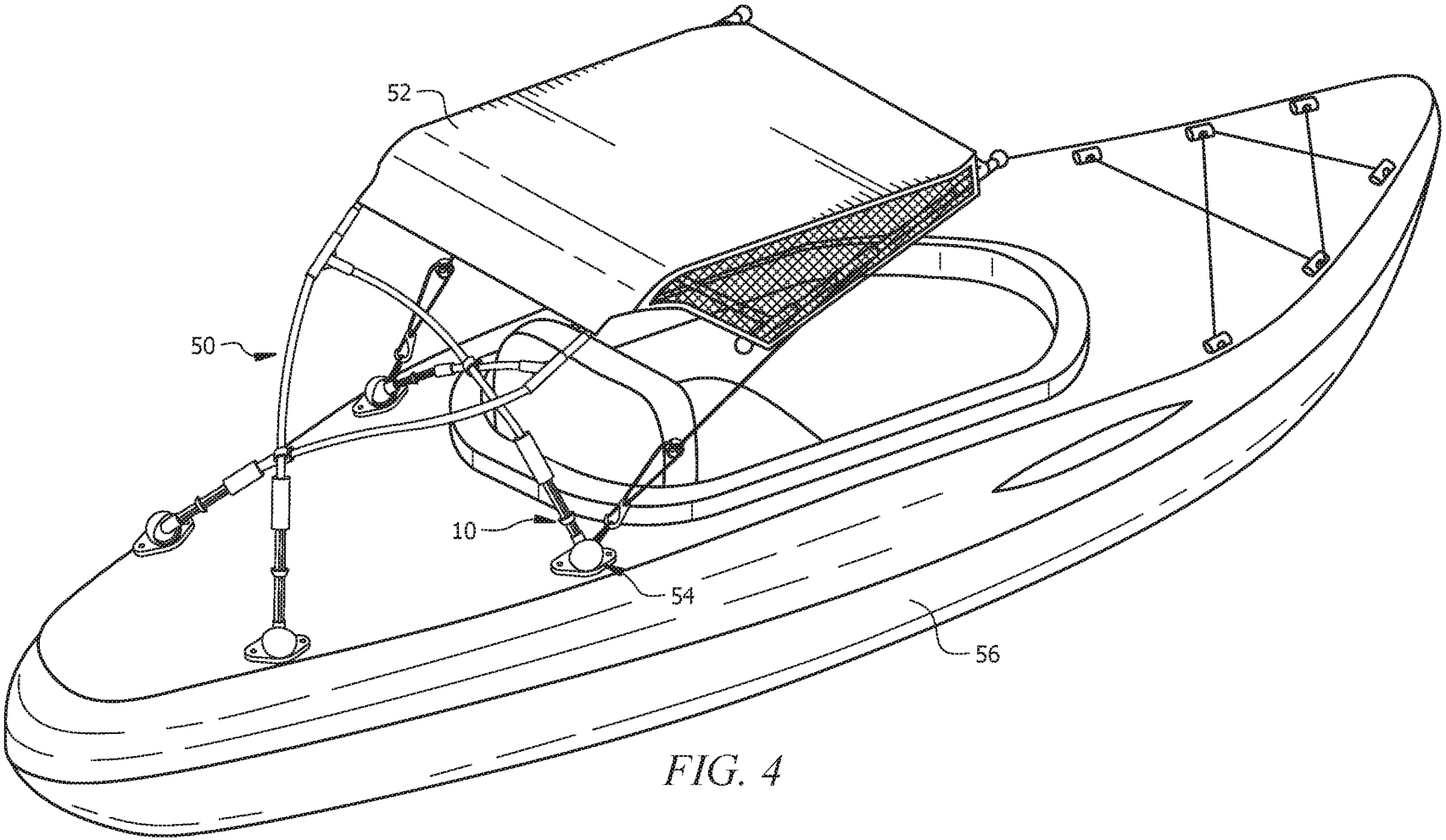
FIG. 4 is a perspective view of the channel rod extension system of FIG. 1 implemented in combination with a watercraft vessel, in accordance with an embodiment of the present invention.
Figure 5:
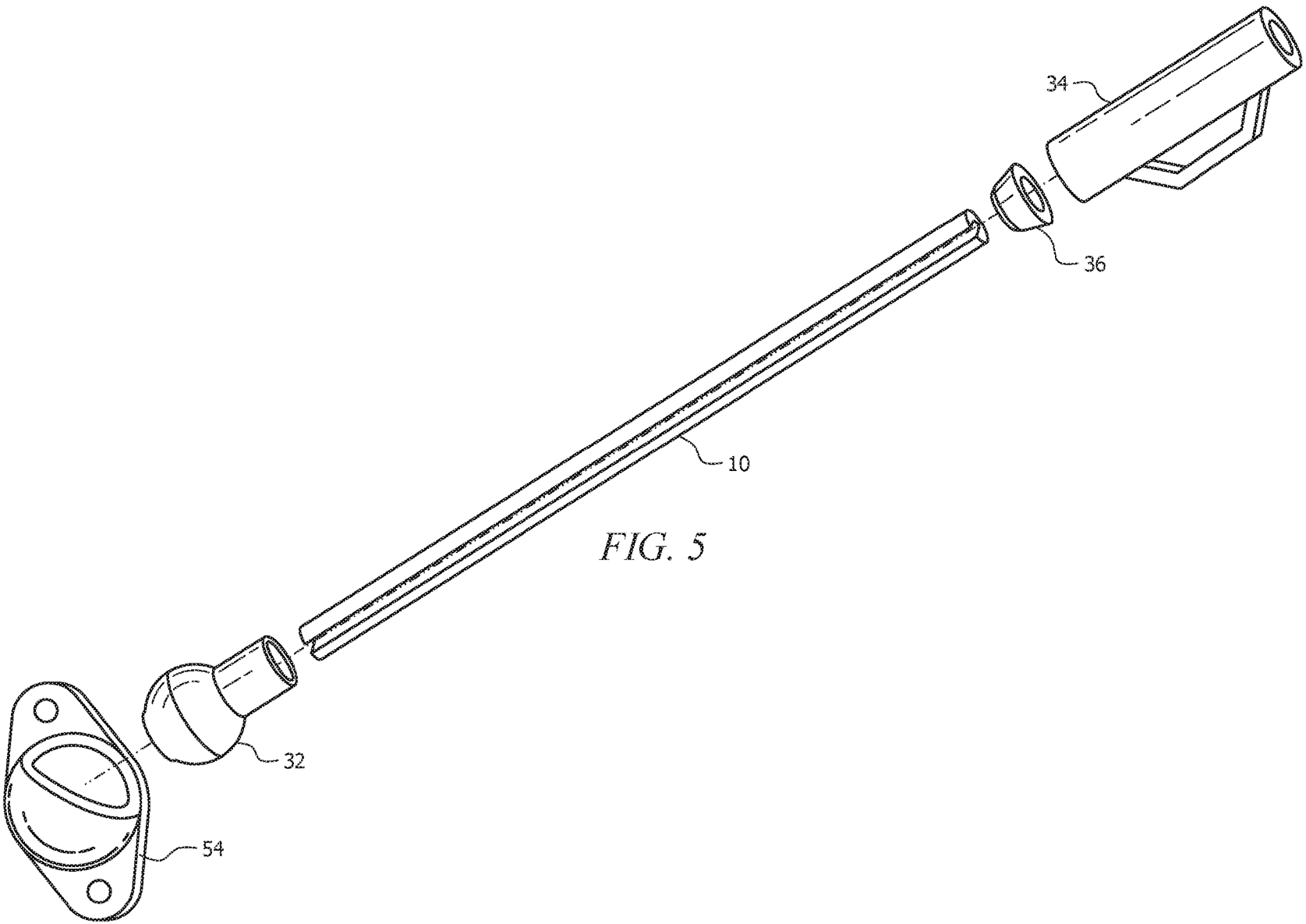
FIG. 5 is a close-up exploded perspective view of an embodiment of the channel rod extension system of FIG. 4.
Figure 6:
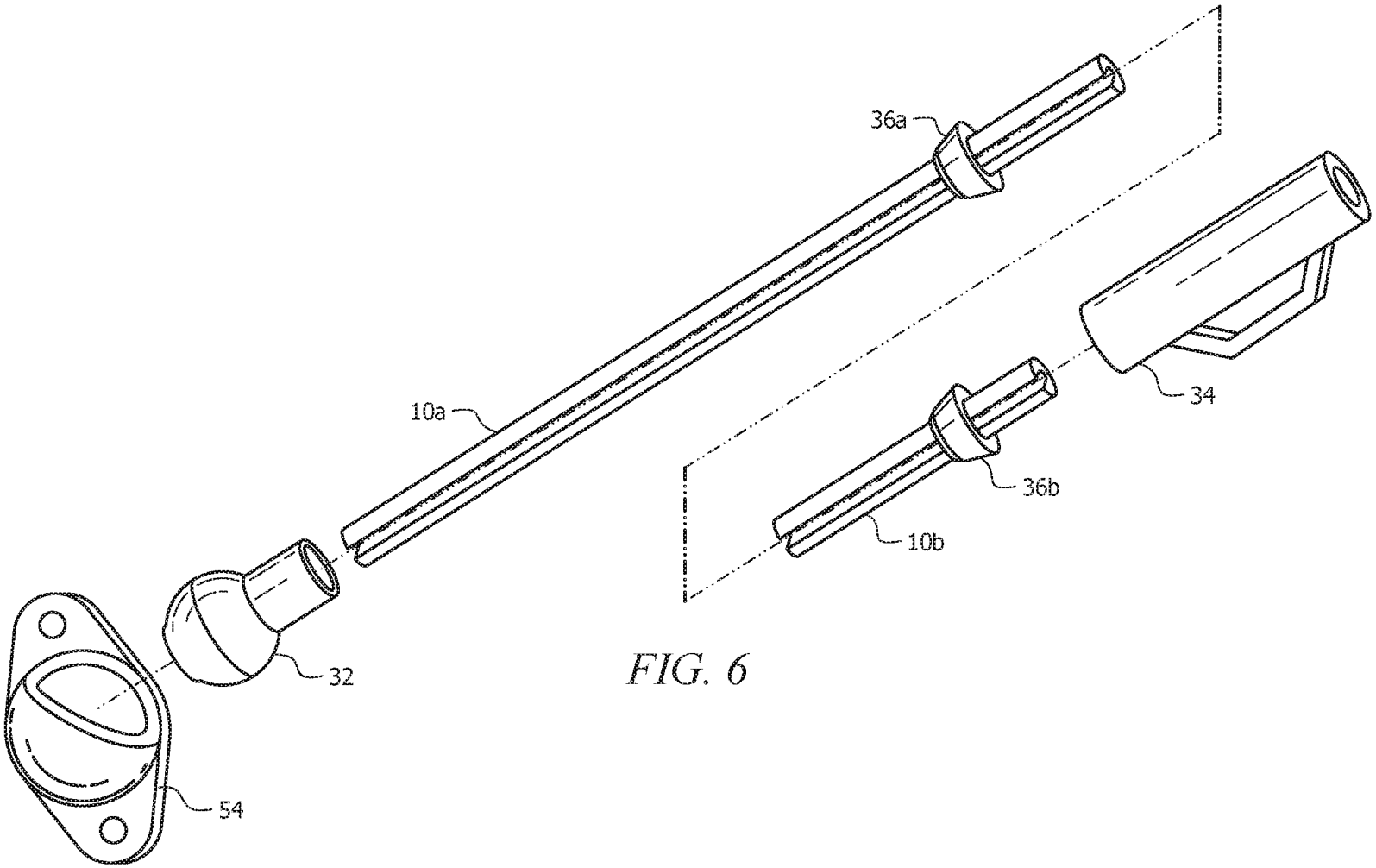
FIG. 6 is a close-up exploded perspective view of an embodiment of the channel rod extension system of FIG. 4.

As shown in FIGS. 1-3, in an embodiment, first end cap 32 includes an attachment connector designed to secure to an anchor point on a greater frame design (shown in detail in FIGS. 4-6). In addition, in the embodiment depicted in FIGS. 1-3, second end cap 34 includes a ferrule connector designed to be used within the frame design shown in FIGS. 4-6. The relationship between extension 10, flexible cord 30, and second end cap 34 will be described in detail later in this specification.

In addition, the retention mechanism shown in FIGS. 1-3 includes retainer 36 that is translatable about body 16 of extension 10, particularly about the longitudinal axis of extension 10. Retainer 36 is shaped such that an inner body surface of retainer 36 defines an opening. The opening defined by the inner body surface of retainer 36 is shaped such that extension 10 is received within the opening and rests against the inner body surface, forming a press fit between extension 10 and retainer 36. Accordingly, retainer 36 includes an inner diameter that is slightly greater than an outer diameter of extension 10. When assembled, retainer 36 exerts inward forces against extension 10, such that both extension 10 and flexible cord 30 are largely immobilized against lateral translation due to retainer 36.

Retainer 36, together with second end cap 34, at least partially defines a length of flexible cord 30 during use. While retainer 36 forms a press fit with extension 10, retainer 36 is also capable of translation about the longitudinal axis of extension 10 between first end 12 and second end 14. To form such a relationship with extension 10, retainer 36 is made of a material having a high coefficient of friction, such as rubber, such that retainer 36 is capable of both retaining flexible cord 30 in place within extension 10 while also retaining the ability to slidably translate along body 16 of extension 10. Moreover, the coefficient of friction of retainer 36 is greater than a coefficient of friction of extension 10, such that retainer 36 remains fixed in place along extension 10 in the absence of receiving a force. In addition, while retainer 36 is designed to reside against extension 10 in an infinite amount of locations between first end 12 and second end 14 thereof, retainer 36 is capable of residing adjacent to second end cap 34.

As such, one method of customizing a length of flexible cord 30 is by positioning retainer 36 in contact with second end cap 34. In a default orientation, with retainer 36 positioned adjacent to second end cap 34, flexible cord 30 includes a first length defined by a resting distance between first end cap 32 and second end cap 34. However, as retainer 36 exerts a force on second end cap 34, translating second end cap 34 further away from first end cap 32, flexible cord 30 includes a second length that is greater than the first length. Moreover, since retainer 36 is made of a material having a high coefficient of friction, retainer 36 not only secures flexible cord 30 in place within extension 10, but also prevents the longitudinal translation of second end cap 34 with respect to extension 10.

While the above discussion focuses on the dimension adjustments capable by extension 10 alone, extension 10 is a universal channel rod extension for use in combination with any flexible cord-based system, achieving true universality regarding retrofitting extension 10 into existing systems. While smaller scale dimension adjustments are capable via retainer 36, larger scale dimension adjustments are capable via channel 20 of extension 10 as well. As an initial matter, a dimension of flexible cord 30 is defined by a corresponding dimension of extension 10; to that end, if extension 10 has a shorter length, flexible cord 30 receives less of a stretching force, such that an effective length of flexible cord 30 is relatively short to substantially match the length of extension 10. However, if extension 10 has a longer length, flexible cord 30 receives a greater stretching force, such that an effective length of flexible cord 30 is greater to substantially match the length of extension 10.

As such, dimension adjustments can be achieved by interchanging extensions 10 having varying lengths, such that a user can adjust a dimension of flexible cord 30 in a default configuration. Such interchangeability can be easily accomplished due to the existence of channel 20, which allows a user to quickly detach extension 10 from flexible cord 30 and replace extension 10 with one of different dimensions. In addition to a replacement of extension 10 for another extension of different dimensions, further dimension customization of flexible cord 30 can be accomplished by coupling individual extensions 10 together while aligning channel 20 of each extension 10. Accordingly, a dimension of flexible cord 30 can be adjusted by increasing a number of extensions 10 used within the flexible cord-based system. Moreover, as noted above, smaller incremental dimension adjustments can be accomplished via the interaction between retainer 36, second end cap 34, extension 10, and flexible cord 30. In the absence of channel 20, each of the adjustments described above would require a disassembly of an entire frame structure, which could not be accomplished during outdoor activities, such as kayaking or otherwise navigating a vehicle with an overhead canopy.

FIGS. 4-6 depict an example of extension 10 used in combination with a greater frame support 50 used to support canopy 52 on a watercraft, such as a kayak. The kayak includes an amount of anchor points 54 disposed about a top surface of the kayak body, such that frame support 50 secures within anchor points 54 to secure frame support 50 to the kayak. Since frame support 50 is designed to include canopy 52, canopy 52 is secured in place indirectly via the interaction between frame support 50 and anchor points 54. However, in a typical support structure, a height of canopy 52 (defined by a distance between canopy 52 and the top surface of the kayak) is fixed and non-adjustable. Moreover, existing adjustment mechanisms are limited to slight incremental changes as a result of the fixed nature of the frame supports, which typically include hollow tubing with elastic cords hidden within the hollow tubing. However, as shown in FIGS. 4-6, the inclusion of one or more extensions 10 within frame support 50 provides a user with the ability to customize a dimension of canopy 54, such as the height and orientation of canopy 54, in real time, without requiring a disassembly of the entire frame support 50. For example, as shown in particular in FIG. 6, first extension 10*a* having a first length can be combined with second extension 10*b*, which can have a length equal to the first length, or can differ from the first length, depending on the requirements of the system. In addition, as shown in FIG. 6, multiple retainers can be used within the system, such as retainer 36*a* and retainer 36*b*, each of which is used to retain flexible cord 30 within one or more extensions 10. As described above, such adjustments can be made by interchanging extensions 10 of different dimensions, adding or removing extensions 10, or adjusting a position of retainer 36 along body 16 of extension 10, as well as other similar adjustment mechanism. As such, a user can easily adjust dimensions of canopy 54, such as the height of canopy 54, depending on his or her torso length, as well as the angle of the sun, to provide an optimal amount of shade for the user.

The advantages set forth above, and those made apparent from the foregoing description, are efficiently attained. Since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention that, as a matter of language, might be said to fall therebetween.

What is claimed is:

1. A channel rod extension system designed for use in combination with a flexible cord-based system, the channel rod extension system comprising:

a channel rod extension having an elongated main body extending between a first end and a second end, the main body including a discontinuous outer surface defining a channel to an interior wall of the main body;

an elongated flexible cord removably secured to the main body, the flexible cord being received within the channel and extending from at least the first end to the second end of the main body;

a first end cap secured to the first end of the main body, the first end cap configured to surmount the first end of the main body to retain the flexible cord within the channel;

a second end cap secured to the second end of the main body, the second end cap configured to surmount the second end of the main body to retain the flexible cord within the channel; and a retainer slidably secured to the main body and disposed between the first end cap and the second end cap, the retainer including a continuous inner-facing wall defining an opening therebetween, the opening spanning an inner diameter greater than an outer diameter of the main body, such that the retainer is configured to retain the flexible cord within the channel.

2. The channel rod extension system of claim 1 wherein the channel extends from the first end to the second end of the main body along a longitudinal axis of the channel rod extension.

3. The channel rod extension system of claim 1 wherein a diameter of the flexible cord is smaller than a diameter of the channel.

4. The channel rod extension system of claim 1 wherein the flexible cord extends from the first end cap to the second end cap.

5. The channel rod extension system of claim 1 wherein the flexible cord is an elastic shock cord.

6. The channel rod extension system of claim 1 wherein the first end cap includes an outer terminal diameter greater than the outer diameter of the main body, such that the first end cap is configured to form an attachment point receivable within an anchor point of a watercraft vessel.

7. The channel rod extension system of claim 1 wherein the first end cap includes an inner diameter greater than the outer diameter of the main body, such that the first end cap surmounts and forms a press fit with the main body.

8. The channel rod extension system of claim 1 wherein the second end cap is a ferrule configured to indirectly secure the channel rod to a frame structure.

9. The channel rod extension system of claim 1 wherein the second end cap includes an inner diameter greater than the outer diameter of the main body, such that the second end cap surmounts and forms a press fit with the main body.

10. The channel rod extension system of claim 1 wherein the retainer is made of a material having a coefficient of friction greater than a coefficient of friction of the main body.

11. The channel rod extension system of claim 1 wherein the retainer is configured to slidably translate along a longitudinal axis of the channel rod extension, such that the retainer is configured to adjust a length of the flexible cord by translating the second end cap in a longitudinal direction away from the first end cap.

12. A channel rod extension system configured to adjust a dimension of a frame structure, the channel rod extension system comprising:

a channel rod extension having an elongated main body extending between a first end and a second end, the main body including a discontinuous outer surface defining a channel to an interior wall of the main body, the channel rod configured to attach to a frame structure;

an elongated flexible cord removably secured to the main body, the flexible cord having a diameter small than a diameter of the channel, such that the flexible cord is removably receivable within the channel and extends from at least the first end to the second end of the main body;

a first end cap secured to the first end of the main body, the first end cap configured to surmount the first end of the main body to retain the flexible cord within the channel;

a second end cap secured to the second end of the main body, the second end cap configured to surmount the second end of the main body to retain the flexible cord within the channel;

a retainer slidably secured to the main body and disposed between the first end and the second end, the retainer including a continuous inner-facing wall defining an opening therebetween, the opening spanning an inner diameter greater than an outer diameter of the main body, the retainer having a coefficient of friction greater than a coefficient of friction of the main body, such that the retainer is configured to retain the flexible cord within the channel, wherein in a default configuration, the flexible cord includes a first length, and wherein in an elongated configuration, the flexible cord includes a second length greater than the first length, and wherein, due to the coefficient of friction of the retainer, the retainer maintains the flexible cord at the second length, thereby adjusting a dimension of the frame structure.

13. The channel rod extension system of claim 12 wherein the first end cap includes an outer terminal diameter greater than the outer diameter of the main body, such that the first end cap is configured to form an attachment point receivable within an anchor point of a watercraft vessel, thereby securing the frame structure to the watercraft vessel.

14. The channel rod extension system of claim 12 wherein the second end cap is a ferrule configured to indirectly secure the channel rod to the frame structure.

15. The channel rod extension system of claim 12 wherein the retainer is configured to slidably translate along a longitudinal axis of the channel rod extension, such that the retainer is configured to adjust a length of the flexible cord by translating the second end cap in a longitudinal direction away from the first end cap.

16. The channel rod extension system of claim 12 wherein the flexible cord is an elastic shock cord.

17. A method of adjusting a dimension of a frame structure via a channel rod extension system, the method comprising the steps of:

securing a flexible cord within a channel of a channel rod extension, the channel being defined by a discontinuous outer surface of the channel rod extension;

coupling a first end of the channel rod extension to an anchor point;

coupling a second end of the channel rod extension to an intermediary connector on a frame structure, the intermediary connector being spaced apart from the anchor point thereby defining an initial position of the intermediary connector;

retaining the flexible cord within the channel via a retainer disposed between the first end and the second end;

slidably translating the retainer along a longitudinal axis of the channel rod extension in a direction toward the second end, the longitudinal axis spanning between the first end and the second end; and via the retainer, translating the intermediary connector along the longitudinal axis away from the anchor point, thereby exerting a force on the flexible cord to elongate the flexible cord, such that the intermediary connector is spaced apart from the anchor point to define an extended position, the extended position being greater than the initial position.

18. The method of claim 17 wherein the channel rod extension is a first channel rod extension, further comprising a step of replacing the first channel rod extension with a second channel rod extension, the second channel rod extension having a length greater than an associated length of the first channel rod extension, such that the second channel rod extension adjusts the dimension of the frame structure.

19. The method of claim 17 further comprising a step of wherein the channel rod extension is a first channel rod extension, further comprising the steps of:

disposing a second channel rod extension adjacent to the first channel rod extension;

aligning a channel of the second channel rod extension with the channel of the first channel rod extension; and securing the flexible cord within the channel of each of the first channel rod extension and the second channel rod extension, thereby adjusting the dimension of the frame structure.

* * * * *